US011004398B2

(12) United States Patent
Shih et al.

(10) Patent No.: US 11,004,398 B2
(45) Date of Patent: May 11, 2021

(54) ELECTRONIC DEVICE

(71) Applicant: InnoLux Corporation, Miao-Li County (TW)

(72) Inventors: Ming-Chia Shih, Miao-Li County (TW); Ming-Chun Tseng, Miao-Li County (TW); Chung-Kuang Wei, Miao-Li County (TW); Chin-Lung Ting, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/666,955

(22) Filed: Oct. 29, 2019

(65) Prior Publication Data

US 2020/0160790 A1 May 21, 2020

Related U.S. Application Data

(60) Provisional application No. 62/769,608, filed on Nov. 20, 2018.

(30) Foreign Application Priority Data

Aug. 23, 2019 (CN) ..... 201910782951.1

(51) Int. Cl.
*G09G 3/3266* (2016.01)
*G09G 3/20* (2006.01)

(52) U.S. Cl.
CPC ..... *G09G 3/3266* (2013.01); *G09G 3/2003* (2013.01); *G09G 2310/06* (2013.01);
(Continued)

(58) Field of Classification Search
None
See application file for complete search history.

(56) References Cited

U.S. PATENT DOCUMENTS

2006/0125739 A1* 6/2006 Tsutsui ..... G09G 3/2011 345/76
2009/0195483 A1* 8/2009 Naugler, Jr. ..... G09G 3/3233 345/76

(Continued)

FOREIGN PATENT DOCUMENTS

CN 106097972 A 11/2016
CN 106448565 A 2/2017
WO 2018/188327 A1 10/2018

OTHER PUBLICATIONS

European Search Report dated Mar. 13, 2020, issued in application No. EP 19209112.2.

(Continued)

*Primary Examiner* — Ryan M Gray
(74) *Attorney, Agent, or Firm* — McClure, Qualey & Rodack, LLP

(57) ABSTRACT

An electronic device includes a power source unit and an electronic unit. The electronic unit includes a first switch, a light-emitting unit, and a plurality of pulse switches. The first switch is coupled to the power source unit, and the first switch has a gate electrode. The light-emitting unit is coupled to the first switch. The plurality of pulse switches are coupled to the gate electrode of the first switch. Therefore, the brightness of the light-emitting unit may be effectively controlled to improve the quality of the electronic device.

14 Claims, 12 Drawing Sheets

(52) U.S. Cl.
CPC ..... *G09G 2320/0233* (2013.01); *G09G 2330/028* (2013.01)

(56) References Cited

U.S. PATENT DOCUMENTS

| | | | | |
|---|---|---|---|---|
| 2011/0149165 | A1* | 6/2011 | Tsuchiya | G09G 3/3648 348/624 |
| 2012/0050350 | A1* | 3/2012 | Matsui | G09G 3/3266 345/690 |
| 2012/0313922 | A1* | 12/2012 | Toyomura | G09G 3/3225 345/212 |
| 2015/0116379 | A1* | 4/2015 | Lim | G02F 1/133603 345/691 |
| 2016/0049113 | A1* | 2/2016 | Park | G09G 3/3266 345/212 |
| 2017/0004754 | A1* | 1/2017 | Chin | G09G 3/32 |
| 2018/0019292 | A1* | 1/2018 | Osame | G09G 3/3233 |
| 2018/0197479 | A1* | 7/2018 | Chen | G09G 3/3233 |
| 2018/0218673 | A1 | 8/2018 | Li | |
| 2018/0277036 | A1* | 9/2018 | Maeda | G09G 3/32 |
| 2019/0006452 | A1* | 1/2019 | Cho | G09G 3/3233 |
| 2020/0135100 | A1* | 4/2020 | Park | G09G 3/3258 |

OTHER PUBLICATIONS

Chinese language office action dated Nov. 2, 2020, issued in application No. CN 201910782951.1.

* cited by examiner

ELECTRONIC DEVICE

CROSS REFERENCE TO RELATED APPLICATIONS

This application claims priority of U.S. Provisional Application No. 62/769,608, filed Nov. 20, 2018, and China Patent Application No. 201910782951.1, filed on Aug. 23, 2019, the entirety of which is incorporated by reference herein.

BACKGROUND OF THE DISCLOSURE

Field of the Disclosure

An embodiment of the disclosure relates to an electronic device, and in particular to an electronic device capable of controlling the brightness of a light-emitting unit.

Description of the Related Art

The light-emitting unit of a conventional electronic device may generate light with a brightness that corresponds to a particular gray level. However, due to differences in the manufacturing process, the brightness produced by different light-emitting units may be different despite their having the same driving voltage. This can negatively affect the quality of the display device. Therefore, a new design for a circuit structure is needed to solve the above problem.

BRIEF SUMMARY OF THE DISCLOSURE

An embodiment of the disclosure provides an electronic device, thereby changing a circuit design or changing a basic gray-level voltage to control the brightness of a light-emitting unit, so as to improve the quality of the electronic device.

An embodiment of the disclosure provides an electronic device, which includes a power source unit and an electronic unit. The electronic unit includes a first switch, a light-emitting unit, and a plurality of pulse switches. The first switch is coupled to the power source unit. The first switch includes a gate electrode. The light-emitting unit is coupled to the first switch. The pulse switches are coupled to the gate electrode of the first switch.

In addition, an embodiment of the disclosure provides an electronic device, which includes a first electronic unit and a second electronic unit. The first electronic unit corresponds to a first basic gray-level voltage. The second electronic unit corresponds to a second basic gray-level voltage. The first basic gray-level voltage and the second basic gray-level voltage are different.

BRIEF DESCRIPTION OF THE DRAWINGS

The disclosure can be fully understood by reading the subsequent detailed description and examples with references made to the accompanying drawings, wherein.

DETAILED DESCRIPTION OF THE DISCLOSURE

Figure 1:
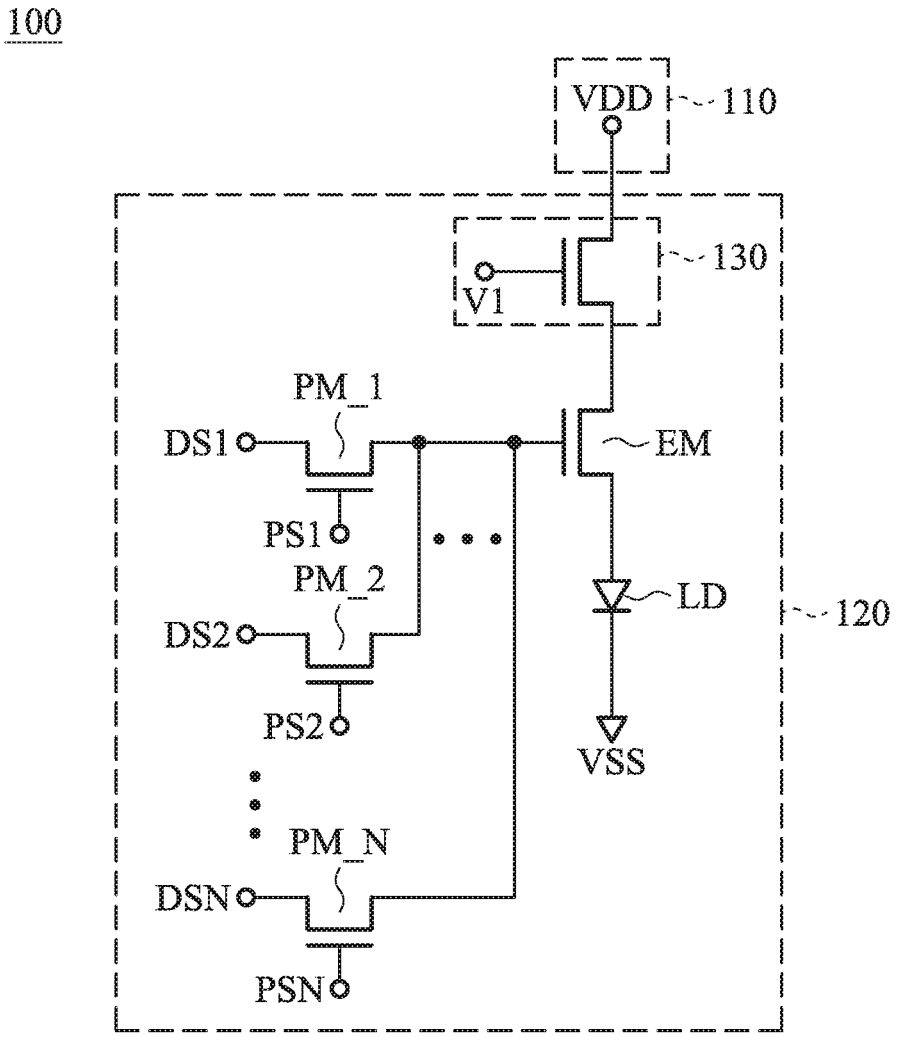
FIG. 1 is a schematic view of an electronic device according to an embodiment of the disclosure.

In order to make objects, features and advantages of the disclosure more obvious and easily understood, the embodiments are described below, and the detailed description is made in conjunction with the drawings. In order to help the reader to understand the drawings, the multiple drawings in the disclosure may merely depict a part of the entire device, and the specific components in the drawing are not drawn to scale.

The specification of the disclosure provides various embodiments to illustrate the technical features of the various embodiments of the disclosure. The configuration, quantity, and size of each component in the embodiments are for illustrative purposes only, and are not intended to limit the disclosure. In addition, if the reference number of a component in the embodiments and the drawings appears repeatedly, it is for the purpose of simplifying the description, and does not mean to imply a relationship between different embodiments.

Furthermore, use of ordinal terms such as "first", "second", etc., in the specification and the claims to describe a claim element does not by itself connote and represent the claim element having any previous ordinal term, and does not represent the order of one claim element over another or the order of the manufacturing method, either. The ordinal terms are used merely as labels to distinguish one claim element having a certain name from another element having the same name.

In the disclosure, the technical features of the various embodiments may be replaced or combined with each other to complete other embodiments without being mutually exclusive.

FIG. 1 is a schematic view of an electronic device according to an embodiment of the disclosure. Please refer to FIG. 1. The electronic device 100 includes a power source unit 110 and an electronic unit 120. The power source unit 110 provides a power source VDD, wherein the voltage of the power source VDD may be, for example, a system voltage. In an embodiment, the electronic device 100 may include liquid crystal (LC), an organic light-emitting diode (OLED), a light-emitting diode (LED), quantum dot (QD), a fluorescent material, a phosphorescent material, other suitable materials, or a combination thereof, but the disclosure is not limited thereto. The light-emitting diode may include, for example, a mini light-emitting diode (mini LED), a micro light-emitting diode (micro LED) or a quantum dot light-emitting diode (QLED/QDLED). In some embodiments, the electronic device 100 may be a display device, a sensing device, a lighting device, an antenna device, a spliced device, a flexible device, another suitable device, or a combination thereof, but the disclosure is not limited thereto. When the electronic device 100 is a display device, the electronic unit 120 may be a sub-pixel.

In FIG. 1, there is one electronic unit 120, but the disclosure is not limited thereto. In some embodiments, the electronic device 100 may include a plurality of electronic units 120, a plurality of data lines, and a plurality of scan lines. One electronic unit 120 may include a first switch EM, a light-emitting unit LD, and a plurality of pulse switches PM_1~PM_N, wherein N is a positive integer greater than 1. The first switch EM is coupled to the power source unit 110. In an embodiment, the first switch EM may be a thin film transistor (TFT), but the disclosure is not limited thereto. A gate electrode of the first switch EM is coupled to the pulse switches PM_1~PM_N, one electrode of the first switch EM is coupled to the power source unit 110, and another electrode of the first switch EM is coupled to the light-emitting unit LD.

In addition, the electronic unit 120 may be coupled to the corresponding data lines through the data receiving terminals DS1~DSN and/or it may be coupled to the corresponding scan lines through the pulse receiving terminal PS1~PSN. For convenience of description, it should be noted that the reference numbers DS1~DSN in the disclosure not only represent the different data receiving terminals respectively, but also represent the data signals corresponding to the different data receiving terminals respectively. Similarly, the reference numbers PS1~PSN in the disclosure not only represent the different pulse receiving terminals respectively, but also represent the pulse signals corresponding to the different pulse receiving terminals respectively. In addition, the pulse receiving terminals PS1~PSN may serve as gate electrodes of the corresponding pulse switches PM_1~PM_N respectively, or they may be respectively coupled to the gate electrodes of the corresponding pulse switches PM_1~PM_N.

In some embodiments, the light-emitting unit LD may be an OLED or a LED (such as a mini LED, a micro LED, or a QLED/QD-LED), but the disclosure is not limited thereto. A first terminal (such as an anode terminal) of the light-emitting unit LD is coupled to the first switch EM and a second terminal (such as a cathode terminal) of the light-emitting unit LD is coupled to a reference voltage VSS (such as a ground voltage), but the disclosure is not limited thereto.

In some embodiments, the pulse switches PM_1~PM_N may be thin film transistors, but the disclosure is not limited thereto. Furthermore, the gate electrodes of the pulse switches PM_1~PM_N receive the pulse signals PS1~PSN respectively. Electrodes of the pulse switches PM_1~PM_N are coupled to the gate electrode of the first switch EM, and other electrodes of the pulse switches PM_1~PM_N receive the data signals DS1~DSN respectively. For example, the pulse switch PM_1 may receive data signal DS1. The pulse switch PM_2 may receive data signal DS2, and so on. In some embodiments, each of the data signals DS1~DSN may have a high voltage level "1" or a low voltage level "0".

In some embodiments, the electronic device 100 may receive and/or display a large amount of image data, wherein the image data may have at least one gray-level number, and the gray-level number corresponds to, for example, the number of gray-level bit, such as N. For example, when the number of gray-level bit is 7, the gray-level number of the image data are 128 ($2^7$=128, the brightness may vary between gray level 0 gray level 127). Similarly, when the number of gray-level bit is 10, the gray-level number of the image data is 1024 ($2^{11}$)=1024, the brightness may vary between gray level 0~gray level 1023). The relationship between other gray-level numbers and the corresponding number of gray-level bit may follow similar rules.

In some embodiments, in one electronic unit 120, the number of pulse switches PM_1~PM_N is equal to the number of gray-level bit. That is, when the number of the gray-level bit is 7, there are also 7 pulse switches in one electronic unit 120, namely, pulse switches PM_1~PM_7. When the number of the gray-level bit is 10, there are also 10 pulse switches in one electronic unit 120, namely, pulse switches PM_1~PM_10, and so on.

Furthermore, the electronic device may also include a driving unit 130. The driving unit 130 is coupled between the power source unit 110 and the first switch EM. A gate electrode of the driving unit 130 receives a voltage V1, wherein the voltage V1 may have a fixed range, but the disclosure is not limited thereto. In some embodiments, the driving unit 130 may be a thin film transistor, but the disclosure is not limited thereto.

Figure 2:
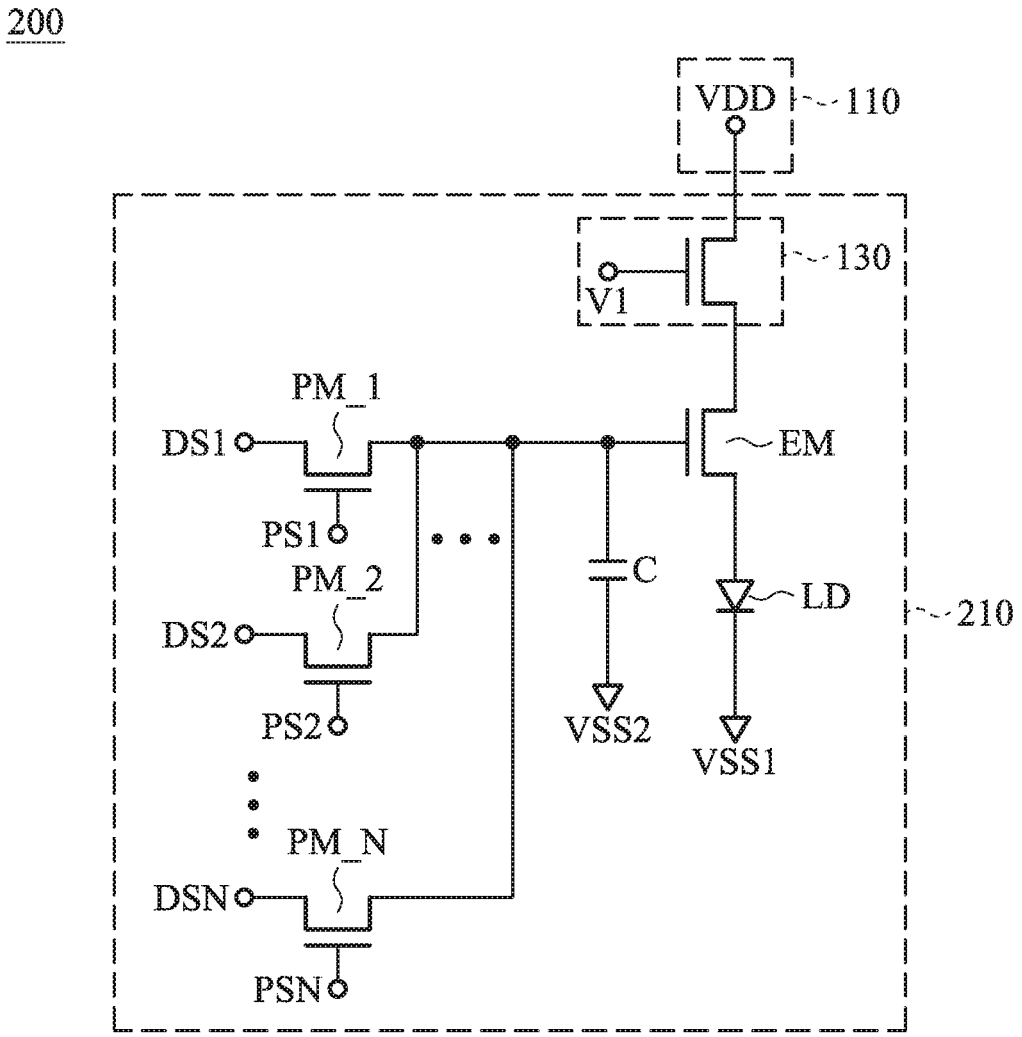
FIG. 2 is a schematic view of an electronic device according to another embodiment of the disclosure.

FIG. 2 is a schematic view of an electronic device according to another embodiment of the disclosure. Please refer to FIG. 2. The electronic device 200 includes a power source unit 110 and an electronic unit 210. In the embodiment, the power source unit 110 in FIG. 2 may be equal to or similar to the power source unit 110 in FIG. 1, and the description thereof is not repeated herein.

In the embodiment, one electronic unit 210 includes a first switch EM, a light-emitting unit LD, a plurality of pulse switches PM_1~PM_N, a driving unit 130 and a capacitor C, wherein N is a positive integer greater than 1. In the embodiment, the first switch EM, the light-emitting unit LD, the pulse switches PM_1~PM_N and the driving unit 130 in FIG. 2 are equal to or similar to the first switch EM, the light-emitting unit LD, the pulse switches PM_1~PM_N and the driving unit 130 in FIG. 1. Therefore, the description thereof is not repeated herein.

The capacitor C is coupled to the gate electrode of the first switch EM. Furthermore, a first terminal of the capacitor C is coupled to the gate electrode of the first switch EM, and a second terminal of the capacitor C may be coupled to a reference voltage VSS2 (such as a ground voltage). In the embodiment, the reference voltage VSS2 may be equal to or different from the reference voltage VSS1 coupled to the light-emitting unit LD.

Figure 3A:
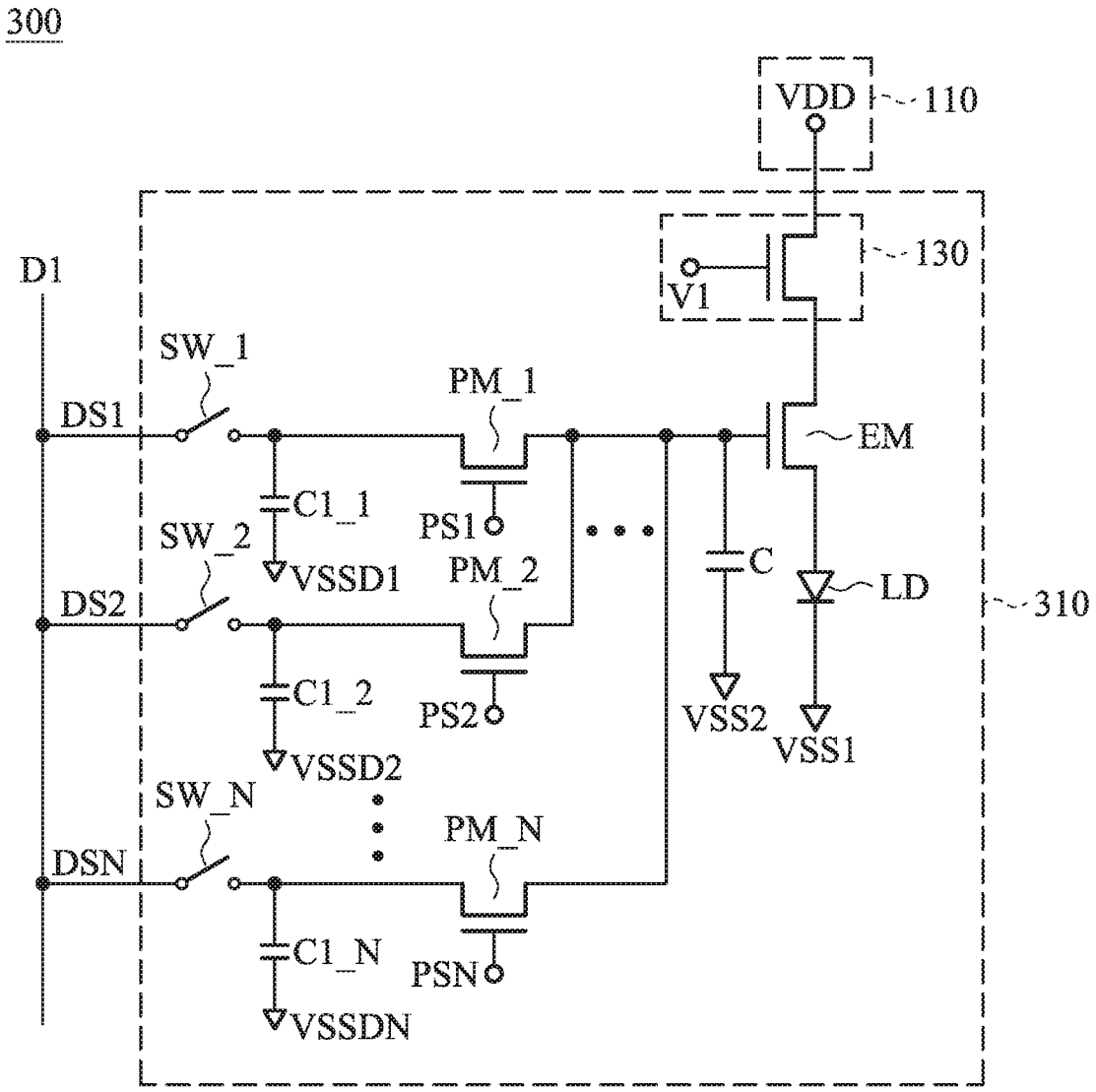
FIG. 3A is a schematic view of an electronic device according to another embodiment of the disclosure.

FIG. 3A is a schematic view of an electronic device according to another embodiment of the disclosure. Please refer to FIG. 3A. The electronic device 300 includes a power source unit 110 and an electronic unit 310. In an embodiment, the power source unit 110 in FIG. 3A may be equal to or similar to the power source unit 110 in FIG. 1, and the description thereof is not repeated herein.

In the embodiment, one electronic unit 310 includes a first switch EM, a light-emitting unit LD, a plurality of pulse switches PM_1~PM_N, a driving unit 130, a capacitor C, a plurality of storage capacitors C1_1~C1_N and a plurality of second switches SW_1~SW_N, wherein N is a positive integer greater than 1. In an embodiment, the first switch EM, the light-emitting unit LD, the pulse switches PM_1~PM_N, the driving unit 130 and the capacitor C in FIG. 3A are equal to or similar to the first switch EM, the light-emitting unit LD, the pulse switches PM_1~PM_N, the driving unit 130, and the capacitor C in FIG. 2, and the description thereof is not repeated herein. In addition, in the embodiment, the number of storage capacitors C1_1~C1_N and second switches SW_1~SW_N is equal to the number of pulse switches PM_1~PM_N. In some embodiments, the number of storage capacitors and second switches may not be equal to the number of pulse switches PM_1~PM_N. For example, some pulse switches do not have corresponding storage capacitors.

The storage capacitors C1_1~C1_N are coupled to the respective pulse switches PM_1~PM_N. Furthermore, the first terminals of the storage capacitors C1_1~C1_N are respectively coupled to the electrodes of the corresponding pulse switches PM_1~PM_N and the first terminals of the corresponding second switches SW_1~SW_N. The second terminals of the storage capacitors C1_1~C1_N are coupled to the reference voltages VSSD1~VSSDN (such as ground voltages) respectively. As in the aforementioned embodiment, the reference voltages VSS2 and VSSD1~VSSDN may be equal to or different from the reference voltage VSS1 coupled to the light-emitting unit LD. The capacitance values of the capacitor C and the storage capacitors C1_1~C1_N may be the same or different. For example, in some embodiments, the capacitance value of the capacitor C is less than the capacitance value of at least one of the storage capacitors C1_1~C1_N, but the disclosure is not limited thereto.

The second switches SW_1~SW_N are coupled to the storage capacitors C1_1~C1_N and a data line D1. Furthermore, first terminals of the second switches SW_1~SW_N are coupled to the first terminals of the storage capacitors C1_1~C1_N, respectively. Second terminals of the second switches SW_1~SW_N are coupled to the data line D1. The control terminals of the second switches SW_1~SW_N are controlled by control signals (not shown in the figure), so as to control whether the data signals DS1~DSN are transmitted from the data line D1 to the electronic unit 310. In addition, the voltage level of each of the data signals DS1~DSN may be, for example, a high voltage level "1" or a low voltage level "0".

Figure 3B:
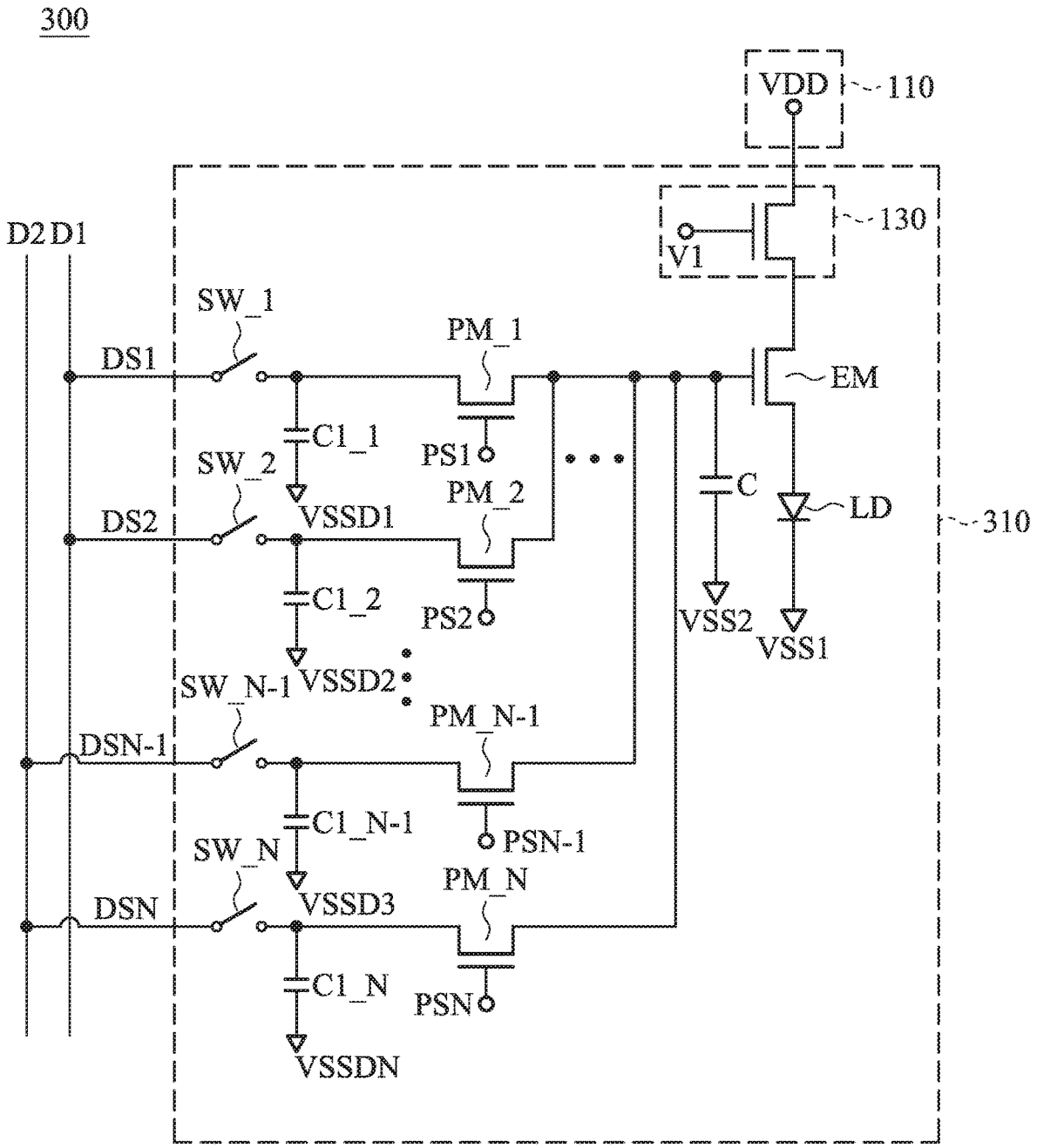
FIG. 3B is a schematic view of an electronic device according to another embodiment of the disclosure.

In an embodiment, the second switches SW_1~SW_N are coupled to the same data line D1. That is, the electronic unit 310 receives data signals DS1~DSN from the same data line D1, but the disclosure is not limited thereto. As shown in FIG. 3B, the second switches SW_1~SW_N may be coupled to data line D1 or data line D2. That is, the electronic unit 310 may receive the data signals DS1~DSN from different data lines D1 and D2. For example, in some embodiments, the second switches SW_1~SW_K are coupled to data line D1, and the second switches SW_K+1~SW_N are coupled to data line D2. In the embodiment, when N is an even number, K is N/2; when N is an odd number, K is (N+1)/2, but the disclosure is not limited thereto. In some embodiments, the odd second switches SW_1~SW_N−1 are coupled to the data line D1, and the even second switches SW_2~SW_N are coupled to the data line D2, but the disclosure is not limited thereto. Therefore, according to the design of the circuit thereby the electronic unit 310 is coupled to multiple data lines, the speed of data writing (i.e., when the data signals DS1~DSN are input to the electronic unit 310 to charge the storage capacitors C1_1~C1_N) may be increased.

In the embodiment illustrated in FIG. 3A or FIG. 3B, the storage capacitors C1_1~C1_N are charged by the data signals DS1~DSN, so that the storage capacitors C1_1~C1_N may store charges. Therefore, since the storage capacitors C1_1~C1_N store the charges, when the pulse switches PM_1~PM_N are turned on, the charges stored in the storage capacitors C1_1~C1_N may be transferred to the capacitor C or may turn on the first switch EM to cause the light-emitting unit LD to emit light, even if the second switches SW_1~SW_N are turned off. That is, when the storage capacitors C1_1~C1_N have already stored the data signals DS1~DSN, even if the data lines D1 and D2 are not coupled to the electronic unit 310, the light-emitting unit LD may also be driven.

In addition, the aforementioned manner of coupling the second switches SW_1~SW_N to the data line D1 or the data line D2 is only one exemplary embodiment of the disclosure, the disclosure is not limited thereto. The user may adjust the manner of coupling the second switches SW_1~SW_N to the data line D1 or the data line D2 to achieve the same effect. Furthermore, the embodiment of FIG. 3B is an example using two data lines, but the disclosure is not limited thereto. The user may change the number of data lines to meet requirements. For example, there may be three or more data lines to achieve the same effect.

Figure 4:
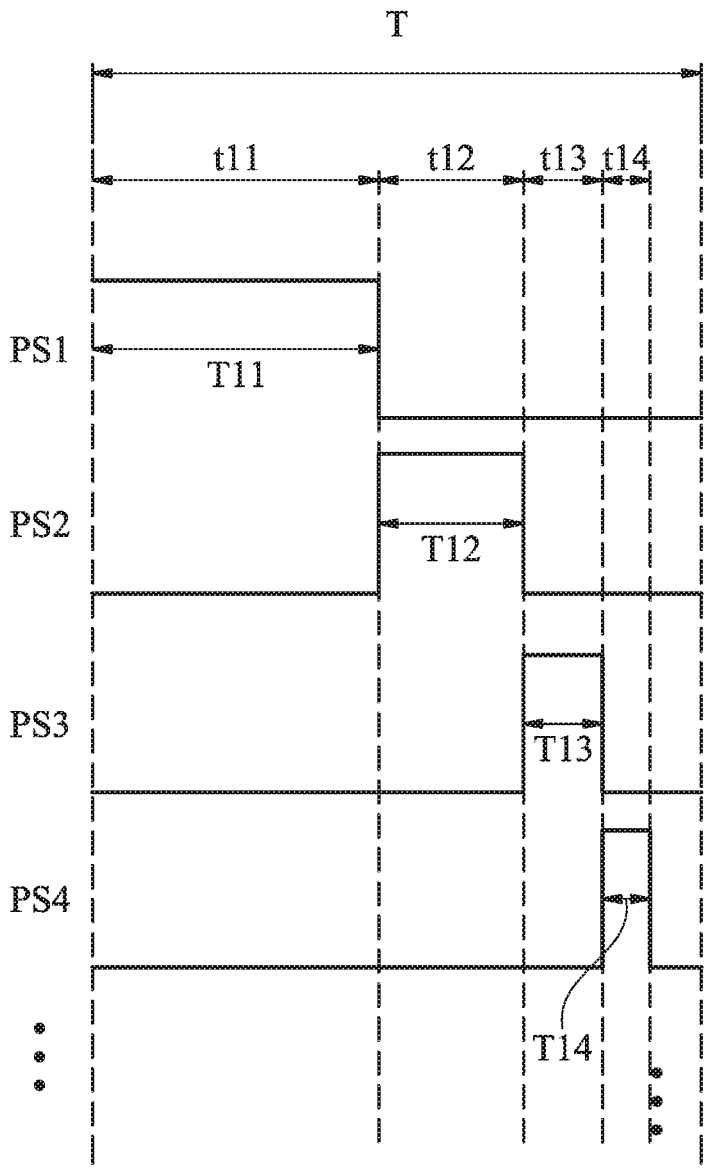
FIG. 4 is a timing diagram of some of the pulse signals according to an embodiment of the disclosure.

FIG. 4 is a timing diagram of some pulse signals according to an embodiment of the disclosure. The timing diagram of FIG. 4 may correspond to the electronic device 100 of FIG. 1, but the disclosure is not limited thereto. In FIG. 4, pulse times T11~T14 respectively represent the pulse times that the pulse signals PS1~PS4 respectively keep the high voltage level "1". In pulse times T11~T14, the pulse switches PM_1~PM_4 may be turned on by the pulse signals PS1~PS4 with the high voltage level. Operation times t11~t14 represent the operation time of the respective pulse switches PM_1~PM_4, and the total time T is the sum of the operation times t11~t1N. It should be noted that an operation time of a pulse switch may be a period that starts when the pulse switch starts to be turned on, and ends when the following pulse switch starts to be turned on. For example, in the embodiment, the operation time t11 of pulse switch PM_1 corresponds to a period which starts when pulse switch PM_1 starts to turn on according to pulse signal PS1 with the high voltage level, and ends when pulse signal PS2 starts to turn on.

Please refer to FIG. 1 and FIG. 4. In FIG. 4, the operation times t11~t14 of the pulse switches PM_1~PM_4 may be substantially equal to the respective pulse times T11~T14. For example, the length of the operation time t11 of the pulse switch PM_1 may correspond to the length of the pulse time T11, and the length of the operation time t12 of the pulse switch PM_2 may correspond to the length of the pulse time T12, and so on. In the operation time t11, only the pulse switch PM_1 can be turned on, and the pulse switches PM_2~PM_4 are not turned on. Then, in operation time t12, only the pulse switch PM_2 can be turned on, and the pulse switches PM_1, PM_3 and PM_4 are not turned on, and so on. It should be noted that in the embodiment of FIG. 4, the operation times t11~t14 corresponding to the pulse switches PM_1~PM_4 are arranged in order and do not overlap each other. That is, the pulse switches PM_1~PM_4 may be turned on in order, when one of the pulse switches is turned on, the other pulse switches are not turned on, but the disclosure is not limited thereto. The order of turning on the pulse switches PM_1~PM_4 may be adjusted according to design.

In the disclosure, the operation times t11~t1N of the pulse switches PM_1~PM_N may be different. Furthermore, the operation time t11 of pulse switch PM_1 is substantially twice as long as the operation time t12 of pulse switch PM_2, and the operation time t12 of pulse switch PM_2 is substantially twice as long as the operation time t13 of pulse switch PM_3, and so on. In the embodiment, the operation times t11~t1N of pulse switches PM_1~PM_N are substantially equal to the respective pulse times T11~T1N. Therefore, the length of pulse time T11 is substantially twice as long as the length of pulse time T12, and the length of pulse time T12 is substantially twice as long as the length of pulse time T13, and so on.

Furthermore, the operation times t11~t1N of the pulse switches PM_1~PM_N may be decreased in order by, for example, a power of two. For example, the ratio of the operation time t11 of the pulse switch PM_1 to the total time T may be $2^{N-1}/(2^N-1)$. The ratio of the operation time t12 of the pulse switch PM_2 to the total time T may be $2^{N-2}/(2^N-1)$. The ratio of the operation time t13 of the pulse switch PM_3 to the total time T may be $2^{N-3}/(2^N-1)$, and so on. It should be noted that when there are more pulse switches in an electronic unit (i.e., the value of N is greater), it represents a higher gray-level number included in the image data, and the operation time t11 of the pulse switch PM_1 is closer to 50% of the total time T, and the operation time t12 of the pulse switch PM_2 is closer to 25% of the total time T, and so on.

For example, when the number of gray-level bit is 10, the gray-level number included in the image data displayed by the electronic device 100 is 1024 ($2^{10}$=1024), wherein the darkest state corresponds to gray level 0, and the brightest state corresponds to a gray level 1023. On the other hand, the light-emitting unit LD of the electronic device 100 may be coupled to the ten pulse switches PM_1~PM_10, and generate different brightness corresponding to 1023 different gray levels ($2^{10}-1$=1023). In some embodiments of the disclosure, the light-emitting unit LD of the electronic device 100 generates a brightness that corresponds to different gray levels through a combination of the operation times t11~t1N of different pulse switches PM_1~PM_N. For example, in some embodiments, during the total time T (not shown in the figure), if the data signal DS1 is at the high voltage level "1" and the data signals DS2~DS_10 (not shown in the figure) are at the low voltage level "0", although the pulse switches PM_1~PM_N may still be turned on in different respective operation times t11~t1N. The electronic unit 120 only receives the data signal DS1 with the high voltage level when the first pulse switch PM_1 is turned on, the first switch EM is turned on during operation time t11, so that the light-emitting unit LD is connected to the power source VDD to emit light. In this example, the brightness presented by the light-emitting unit LD may correspond to gray level 512 ($2^9$=512).

In some embodiments, during the total time T (not shown in the figure), if the data signals D1 and D3 are at the high voltage level "1" and the data signals DS2 and DS_4~DS10 (not shown in the figure) are the low voltage level "0", the brightness produced by the light-emitting unit LD may correspond to gray level 640 ($2^9+2^7$=640).

In some embodiments, during the pulse times T11~T110 (not shown in the figure), if the data signals DS1~DS10 are all at the high voltage level "1", the brightness produced by the light-emitting unit LD may correspond to gray level 1023 ($2^9+2^8+2^7+2^6+2^5+2^4+2^3+2^2+2^1+2^0$=1023). The manner in which the brightness produced by the light-emitting unit LD corresponding to the rest of the gray levels follows similar rules, and the description thereof is not repeated herein.

Figure 5:
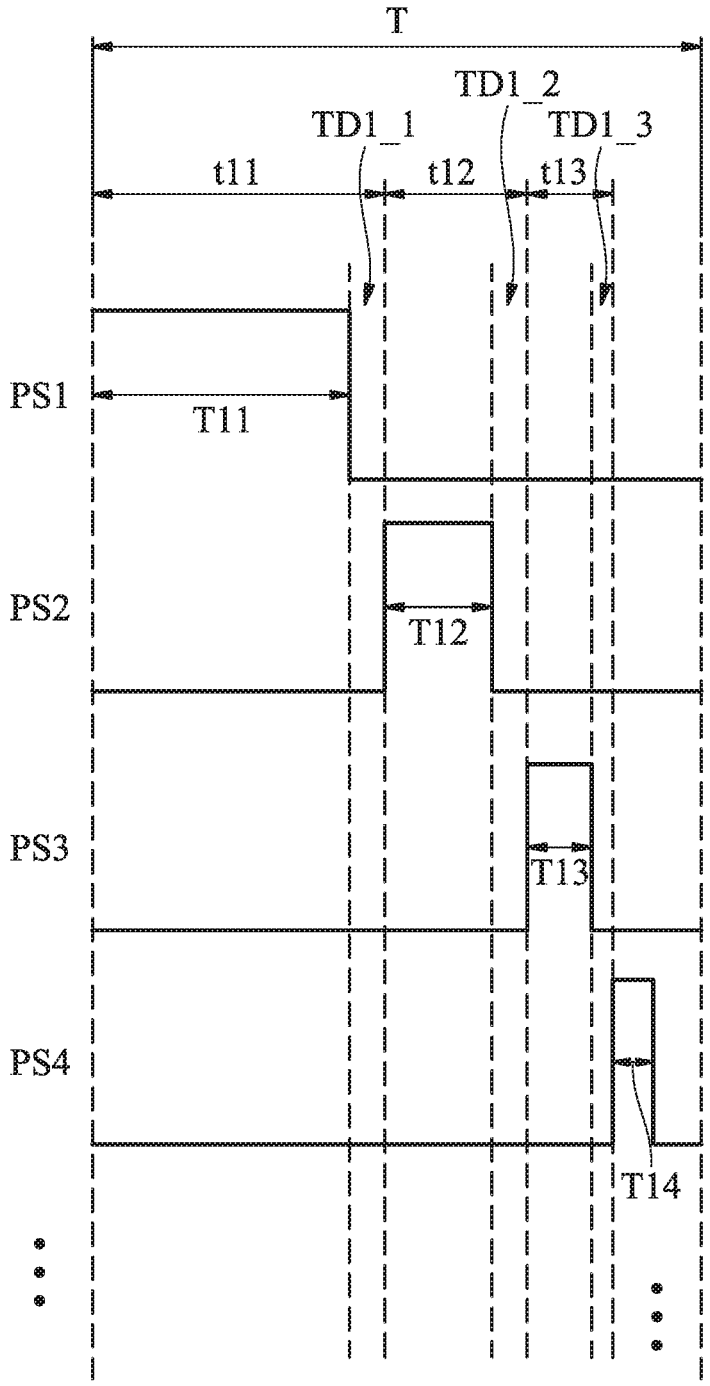
FIG. 5 is another timing diagram of some of the pulse signals according to another embodiment of the disclosure.

FIG. 5 is another timing diagram of some pulse signals according to another embodiment of the disclosure. The timing diagram of FIG. 5 may correspond to the electronic device 200 of FIG. 2, but the disclosure is not limited thereto. Similar to FIG. 4, in FIG. 5, the pulse times T11~T14 represent pulse times when the pulse signals PS1~PS4 are at the high voltage level "1" respectively. In addition, the interval times TD1_1~TD1_3 correspond to the pulse times T11~T13, and the operation times t11~t13 corresponding to the pulse switches PM_1~PM_3 are sums of the pulse times T11~T13 and the corresponding interval times TD1_1~TD1_3 respectively. For example, the operation time t11 of the pulse switch PM_1 is the pulse time T11 plus the interval time TD1_1, and the operation time t12 of the pulse switch PM_2 is the pulse time T12 plus the interval time TD1_2, and so on. The total time T is the sum of all pulse times T11~T1N and all interval times TD1_1~TD1_N.

Please refer to FIG. 2 and FIG. 5. In the embodiment, the operation times t11~t1N of the pulse switches PM_1~PM_N may be different. The manner of setting the operation times t11~t1N of the pulse switches PM_1~PM_N is similar to the embodiment of FIG. 4, and the description thereof is not repeated herein. It should be noted that since the pulse switches PM_1~PM_N are turned on according to the pulse signals PS1~PSN, the pulse switches PM_1~PM_N may not be turned on due to the interval times TD1_1~TD1_N during the operation times t11~t1N. For example, the pulse switch PM_1 is in a turning-on state at the pulse time T11, but the pulse switch PM_1 may turn to a turning-off state from the turning-on state at the interval time TD1_1. The manner of the rest of the pulse switches PM_2~PM_N follows similar rules.

In the embodiment, since there is a capacitor C, the capacitor C may store charges when the pulse switches PM_1~PM_N are turned on, and the first switch EM coupled to the light-emitting unit LD may maintain a turning-on state for a period of time while the pulse switches PM_1~PM_N are not turned on. Therefore, the pulse switches PM_1~PM_N may not be always kept in the turning-on state in the corresponding operation times t11~t1N. In other words, during the interval times TD1_1~TD1_N, the capacitor C may discharge to maintain the turning-on state of the first switch EM.

In addition, the interval times TD1_1~TD1_N may be the same or different. Furthermore, in the embodiment, the manner in which the light-emitting unit LD is driven to emit light so that the brightness of the light-emitting unit LD corresponds to the gray level is equal to or similar to the embodiment of FIG. 4. Therefore, the description thereof is not repeated herein.

Figure 6:
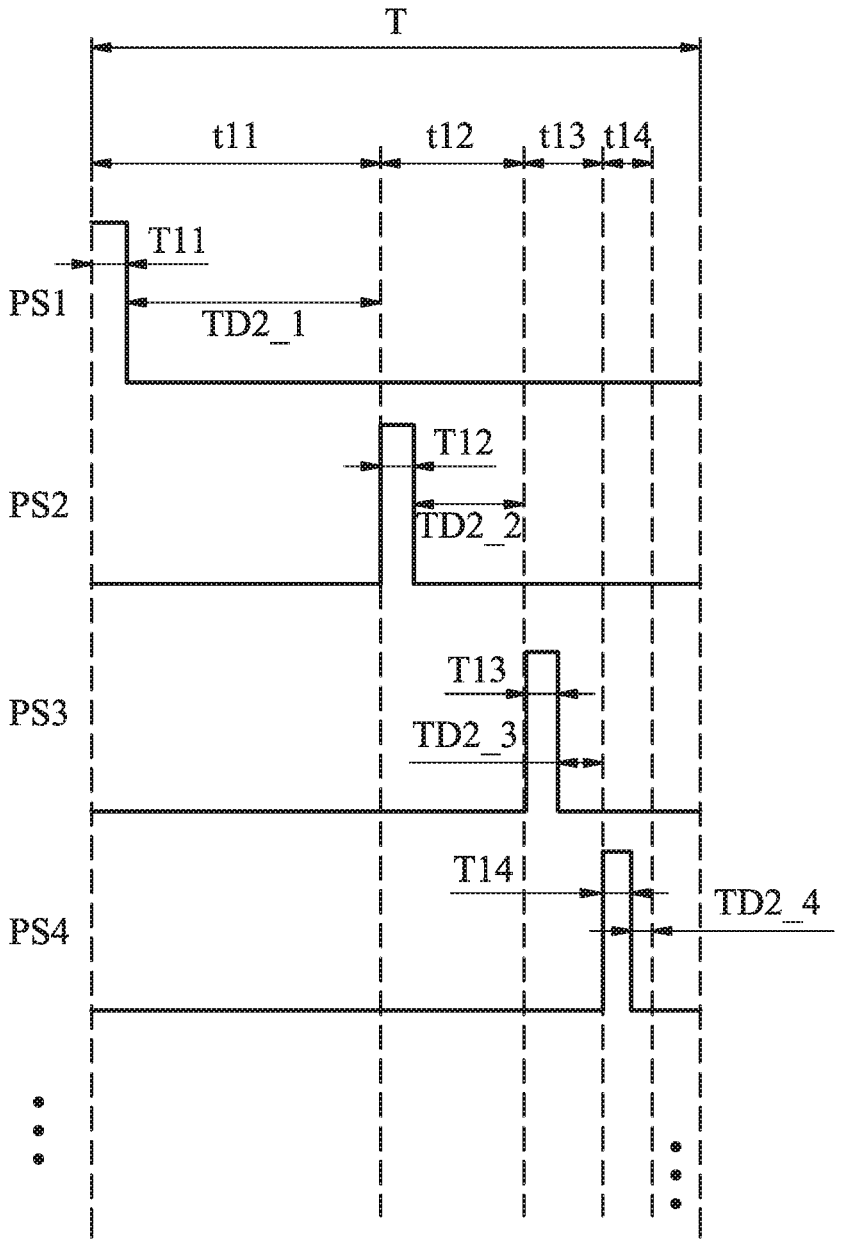
FIG. 6 is another timing diagram of some pulse signals according to an embodiment of the disclosure.

FIG. 6 is another timing diagram of some pulse signals according to an embodiment of the disclosure. Similar to FIG. 5, in FIG. 6, the pulse times T11~T14 represent the times when the respective pulse signals PS1~PS4 are at the high voltage level "1". The interval times TD2_1~TD2_4 correspond to the pulse times T11~T14. The operation times t11~t14 corresponding to the pulse switches PM_1~PM_4 are sums of the pulse times T11~T14 and their corresponding interval times TD2_1~TD2_4 respectively. For example, the operation time t11 of the pulse switch PM_1 is the pulse time T11 plus the interval time TD2_1, and the operation time t12 of the pulse switch PM_2 is the pulse time T12 plus the interval time TD2_2, and so on. The total time T is the sum of all pulse times T11~T1N and all interval times TD2_1~TD2_N. One difference between FIG. 6 and FIG. 5 is that the lengths of pulse times T11~T1N corresponding to the pulse switches PM_1~PM_N in FIG. 6 are similar, so that the lengths of the corresponding interval times TD2_1~TD2_N may be different. For example, the lengths of pulse times T11 and T12 are similar, but the length of the interval times TD2_1 is greater than the length of interval time TD2_2.

In the embodiment, the operation times t11~t1N of the pulse switches PM_1~PM_N may be different, and the manner of setting the operation times of the pulse switches PM_1~PM_N is similar to the embodiment of FIG. 4. Therefore, the description thereof is not repeated herein.

In addition, in the embodiment, interval time TD2_2 may be set to be less than or equal to interval time TD2_1, interval time TD2_3 may be set to be less than or equal to interval time TD2_2, and interval time TD2_4 may be set to be less than or equal to interval time TD2_3, and so on. Furthermore, in the embodiment, the manner by which the light-emitting unit LD is driven to emit light so that the brightness of the light-emitting unit LD corresponds to a gray level is the same as or similar to the embodiment of FIG. 4. Therefore, and the description thereof is not repeated herein.

Figure 7:
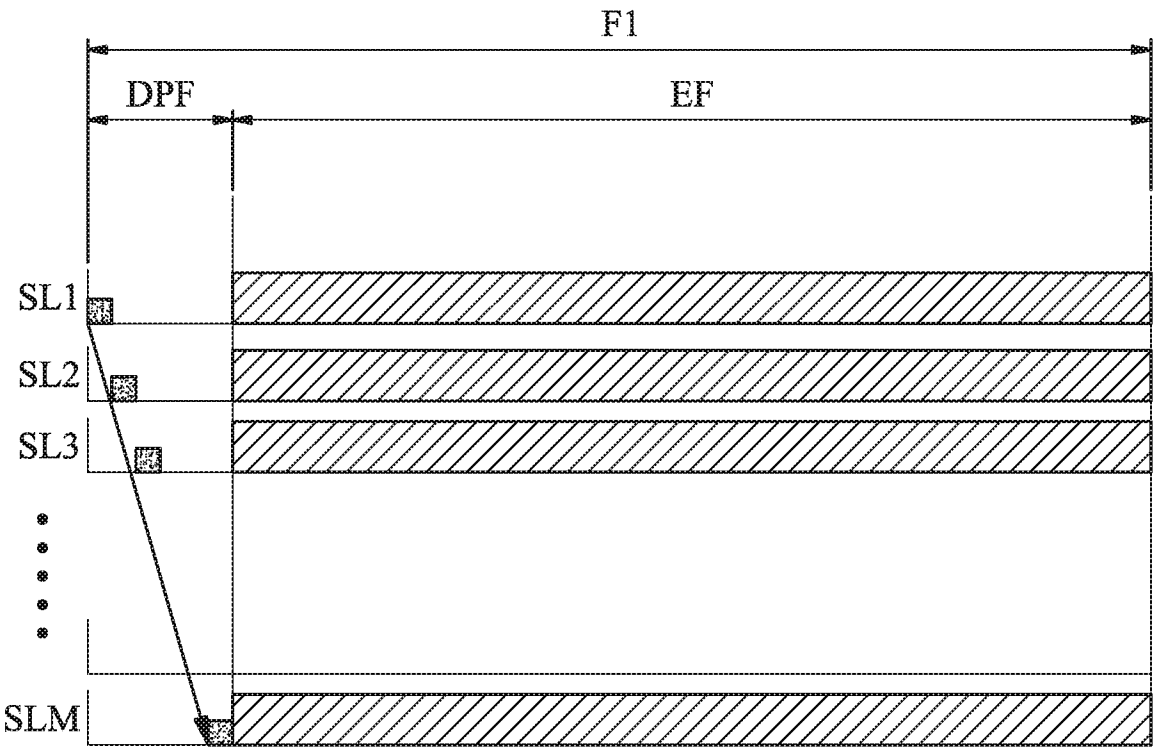
FIG. 7 is a schematic view of driving an image frame of the electronic device according to an embodiment of the disclosure.

FIG. 7 is a schematic view of driving an image frame of the electronic device according to an embodiment of the disclosure. In an embodiment, the driving frequency of the image frame is at least 120 Hz. Furthermore, the driving frequency of the image frame may also be, for example, 240 Hz or 720 Hz, but the disclosure is not limited thereto.

In FIG. 7, the frame time F1 of one image frame includes the data-providing time DPF and the light-emitting time EF of the light-emitting unit. At least one of the scan lines SL1~SLM may transmit a plurality of pulse signals PS1~PSN, and each of the pulse signals PS1~PSN may respectively correspond to one bit, wherein M is a positive integer greater than 1. For example, the scan line SL1 may transmit pulse signals PS1~PSN, wherein pulse signal PS1 corresponds to the first bit, pulse signal PS2 corresponds to the second bit, and pulse signal PSN corresponds to the N-th bit. The rest of the scan lines SL2~SLM and the transmitted pulse signals follow similar rules, and the description thereof is not repeated herein.

In an embodiment, in the data-providing time DPF, the data signals DS1~DSN are sequentially provided to the storage capacitors C1_1~C1_N of the electronic units corresponding to the scan lines SL1~SLM, so as to perform data-writing operations. For example, the data signals DS1~DSN are first provided to the storage capacitors C1_1~C1_N of the electronic unit corresponding to the scan line SL1, so as to perform the data-writing operation. Then, the data signals DS1~DSN are provided to the storage capacitors C1_1~C1_N of the electronic unit corresponding to the scan line SL2, so as to perform the data-writing operation, and so on. In the light-emitting time EF, the light-emitting units LD may be driven to generate the corresponding light. That is, in the embodiment corresponding to FIG. 7, the data signals DS1~DSN are provided to the storage capacitors C1_1~C1_N of the electronic units corresponding to all the scan lines SL1~SLM to complete their data-writing operation, then the light-emitting units LD of the electronic units corresponding to the scan lines SL1~SLM are driven, so that the light-emitting units LD emit corresponding lights.

Figure 8:
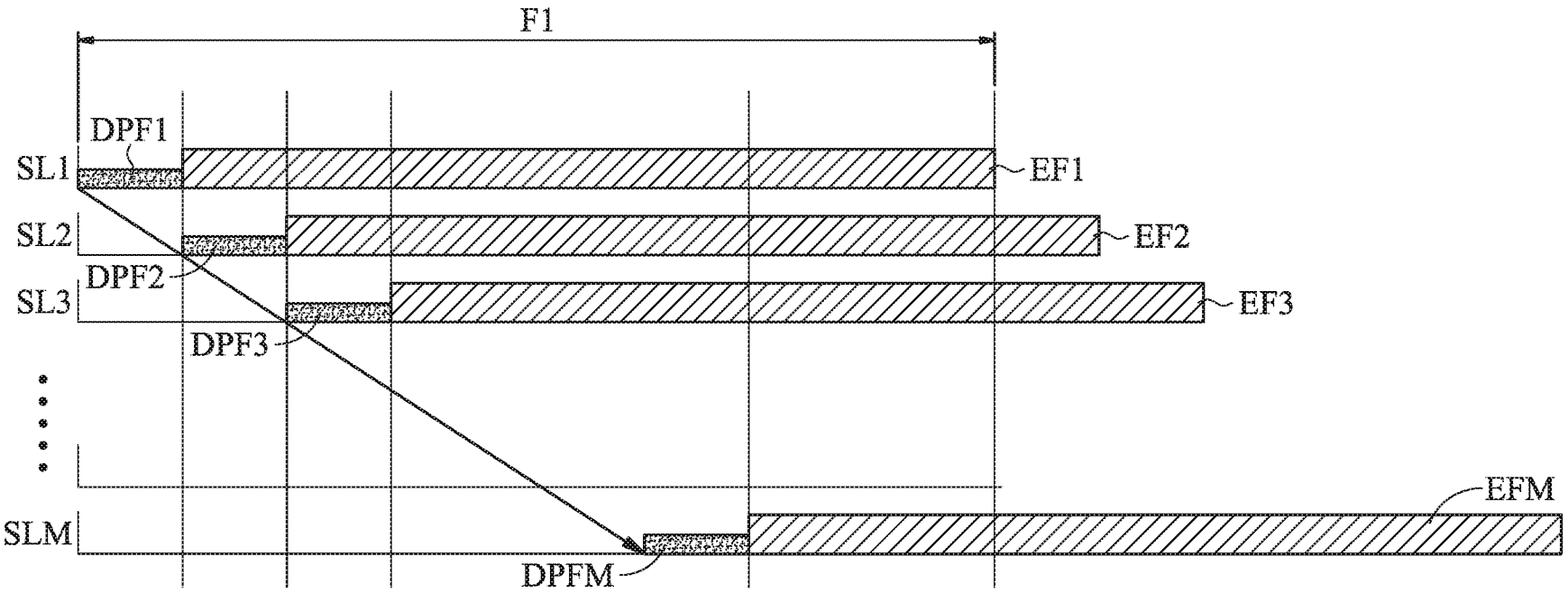
FIG. 8 is a schematic view of another manner of driving an image frame of the electronic device according to an embodiment of the disclosure.

FIG. 8 is a schematic view of another manner of driving an image frame of the electronic device according to an embodiment of the disclosure. In an embodiment, the driving frequency of the image frame is at least 120 Hz. Furthermore, the driving frequency of the image frame may also be, for example, 240 Hz or 720 Hz, but the disclosure is not limited thereto.

In FIG. 8, the scan lines SL1~SLM may transmit a plurality of pulse signals PS1~PSN, and the pulse signals PS1~PSN may respectively correspond to one bit. For example, the scan line SL1 may transmit pulse signals PS1~PSN, wherein pulse signal PS1 corresponds to the first bit, pulse signal PS2 corresponds to the second bit, and pulse signal PSN corresponds to the N-th bit. Similarly, the scan line SL2 may transmit pulse signals PS1~PSN, wherein pulse signal PS1 corresponds to the first bit, pulse signal PS2 corresponds to the second bit, and pulse signal PSN corresponds to the N-th bit. The rest of the scan lines SL3~SLM and the transmitted pulse signals follow similar rules, and the description thereof is not repeated herein.

In addition, in some embodiments, the data-providing times DPF1~DPFM are generated in order. That is, data-providing time DPF2 follows data-providing time DPF1, and data-providing time DPF3 follows data-providing time DPF2, and so on. But the order of the data-providing times DPF1~DPFM is not limited thereto.

In the data-providing time DPF1, the data signals DS1~DSN are provided into the storage capacitors C1_1~C1_N of the electronic unit corresponding to the scan line SL1, so as to perform the data-writing operation. Then, in the light-emitting time EF1, the light-emitting unit LD of the electronic unit corresponding to the scan line SL1 is driven, so that the light-emitting unit LD emits a corresponding light.

In data-providing time DPF2 following data-providing time DPF1, the data signals DS1~DSN are input to the storage capacitors C1_1~C1_N of the electronic unit corresponding to the scan line SL2, so as to perform the data-writing operation. Then, in the light-emitting time EF2, the light-emitting unit LD of the electronic unit corresponding to the scan line SL2 is driven, so that the light-emitting unit LD emits a corresponding light. The rest of the data-providing times DPF3~DPFM and the light-emitting times EF3~EFM corresponding to the scan lines SL3~SLM follow similar rules. That is, after the data signals DS1~DSN are provided to the storage capacitors C1_1~C1_N of the electronic unit corresponding to one scan line to perform the data-writing operation, then the light-emitting unit LD of the electronic unit corresponding to the scan line is driven to emit a corresponding light. Therefore, the light-emitting times EF1~EFM of the light-emitting unit LD of the electronic unit may be effectively increased.

As can be seen from the above description, one difference between FIG. 8 and FIG. 7 is that in the manner of driving that is illustrated in FIG. 7, the electronic units corresponding to all the scan lines SL1~SLM of the electronic device 100 must complete their data-writing operations, then the light-emitting units LD of these electronic units may start to emit light. But, in the manner of driving shown in FIG. 8, when the electronic unit corresponding to one scan line complete its data-writing operation, the light-emitting unit LD of the electronic unit starts to emit light.

Another difference between FIG. 8 and FIG. 7 is that in the manner of driving as shown in FIG. 8, the sum of length of the data-providing time and the light-emitting time corresponding to each of the scan lines substantially equals to the frame time F1 of one image frame. That is, the sum of the data-providing time DPF1 and the light-emitting time EF1 corresponding to the scan line SL1 substantially equals to the frame time F1, and the sum of the data-providing time DPF2 and the light-emitting time EF2 corresponding to the scan line SL2 substantially equals to the frame time F1, and so on.

Figure 9:
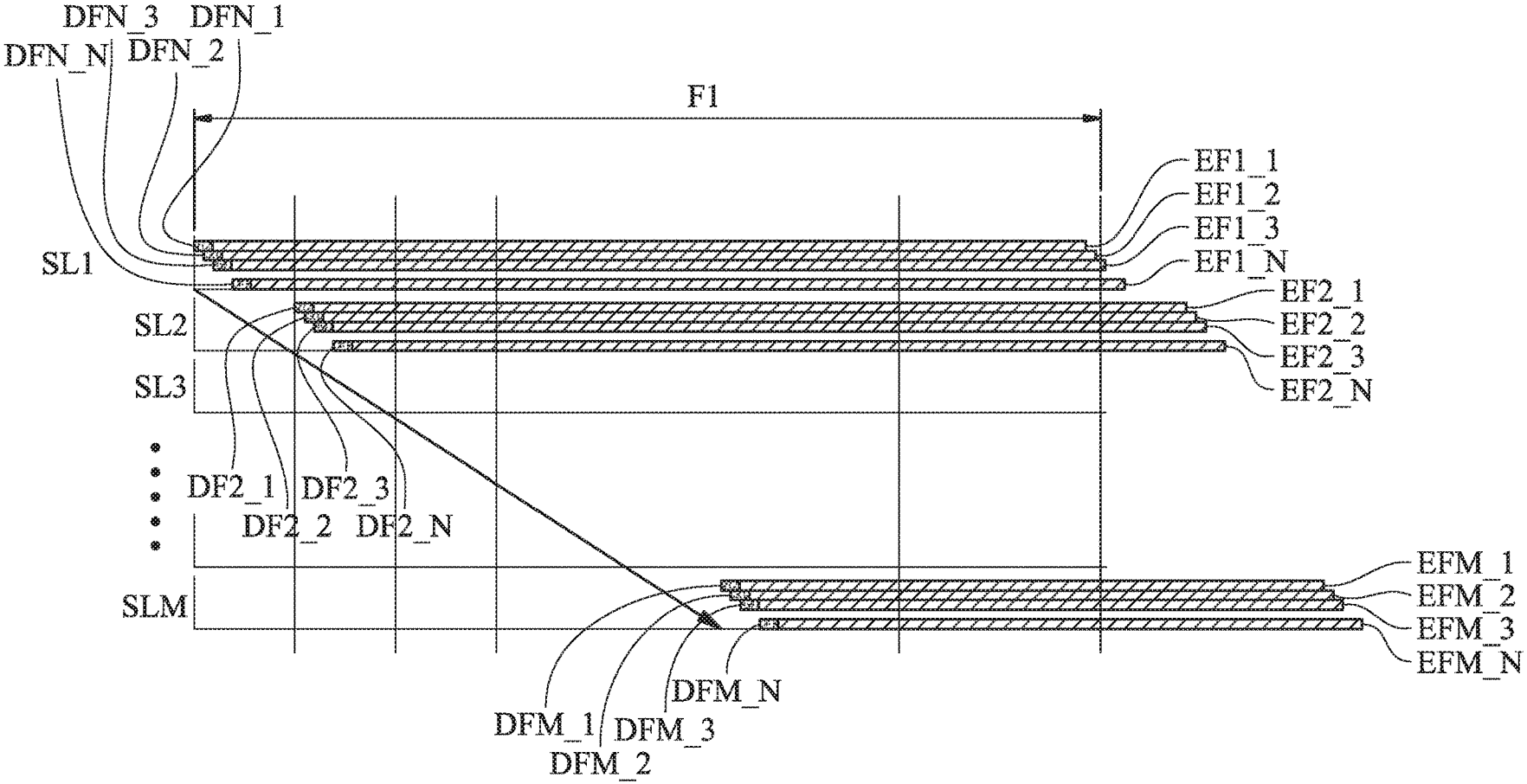
FIG. 9 is a schematic view of another manner of driving an image frame of the electronic device according to an embodiment of the disclosure.

FIG. 9 is a schematic view of another manner of driving an image frame of the electronic device according to an embodiment of the disclosure. As in the previous embodiment, in the embodiment, the driving frequency of the image frame is at least 120 Hz. Furthermore, the driving frequency of the image frame may also be, for example, 240 Hz or 720 Hz, but the disclosure is not limited thereto.

In FIG. 9, the data-providing times DPF1_1~DPFM_N respectively represent the data-providing times that one bit of image data DS1~DSN is received by the corresponding one of the electronic units corresponding to the scan lines SL1~SLM, and the light-emitting times EF1_1~EFM_N respectively represent the times that the light-emitting unit LD of a electronic unit emits when one bit of image data is received by the electronic unit. The scan lines SL1~SLM may respectively transmit a plurality of pulse signals PS1~PSN, and the pulse signals PS1~PSN respectively correspond to one bit. For example, the scan line SL1 may transmit pulse signals PS1~PSN to the corresponding electronic unit, wherein pulse signal PS1 corresponds to a first bit, pulse signal PS2 corresponds to a second bit, and so on. The rest of the scan lines SL2~SLM and the transmitted pulse signals PS1~PSN follow similar rules, and the description thereof is not repeated herein.

In the manner of driving as shown in FIG. 9, one bit corresponds to one data-providing time and one light-emitting time. For example, the 1-st~N-th bits transmitted by the scan line SL1 correspond to the respective data-providing time DPF1_1~DPF1_N and light-emitting time EF1_1~EF1_N, and the 1-st~N-th bits transmitted by the scan line SL2 correspond to the respective data-providing time DPF2_1~DPF2_N and light-emitting time EF2_1~EF2_N, and so on. Furthermore, in some embodiments, the sum of the data-providing time and the light-emitting time corresponding to one bit substantially equals to the frame time F1 of one image frame. That is, the sum of the data-providing time DPF1_1 and the light-emitting time EF1_1 corresponding to the 1-st bit transmitted by the scan line SL1 substantially equals to the frame time F1 of one image frame. The sum of the data-providing time DPF1_2 and the light-emitting time EF1_2 corresponding to the 2-nd bit transmitted by the scan line SL1 substantially equals to the frame time F1 of one image frame, and so on. Similarly, for the bits transmitted by the rest of the scan lines SL2~SLM, the sum of the one of the data-providing times DPF2_1~DPFM_N and the corresponding one of light-emitting times EF2_1~EFM_N substantially equals to the frame times F1 of one image frame (DPF2_1+EF2_1=DPF2_2+EF2_2= . . . =DPFM_N+EFM_N=F1).

For example, according to the driving method shown in FIG. 9, in the electronic unit corresponding to the scan line SL1, in the data-providing time DPF1_1, the first-bit data signal DS1 is firstly provided to the pulse switch PM_1 of the electronic unit corresponding to the scan line SL1, so as to perform the data-writing operation. Then, in the light-emitting time EF1_1 following the data-providing time DPF1_1, the pulse switch PM_1 of the electronic unit corresponding to the first-bit data signal DS1 is turned on, so that the light-emitting unit LD of the electronic unit corresponding to the scan line SL1 emits a corresponding light. In the data-providing time DPF1_2, the second-bit data signal DS2 is provided to the pulse switch PM_2 of the electronic unit corresponding to the scan line SL1, so as to continue the data-writing operation. Then, in the light-emitting time EF1_2 following the data-providing time DPF1_2, the pulse switch PM_2 of the electronic unit corresponding to the second-bit data signal DS2 is turned on, so that the light-emitting unit LD of the electronic unit corresponding to the scan line SL1 corresponding to the scan line SL1 continues emitting a corresponding light, and so on. The relationships between the rest of the data-providing times DPF1_3~DPF1_N and light-emitting times EF1_3~EF1_N corresponding to the scan line SL1 are similar. In addition, the relationships between the rest of the electronic units corresponding to the scan lines SL2~SLM are also similar.

One difference between the driving methods of FIG. 8 and FIG. 9 is that in FIG. 8, the light-emitting unit LD of one electronic unit starts to emit light after the data signals corresponding to the electronic unit are completely received. In the driving method as shown in FIG. 9, the electronic unit may start to emit light when 1 bit of data signal is received, complete data reception is not needed. Therefore, the light-emitting time of the light-emitting unit LD of the electronic unit may be effectively increased.

Figure 10:
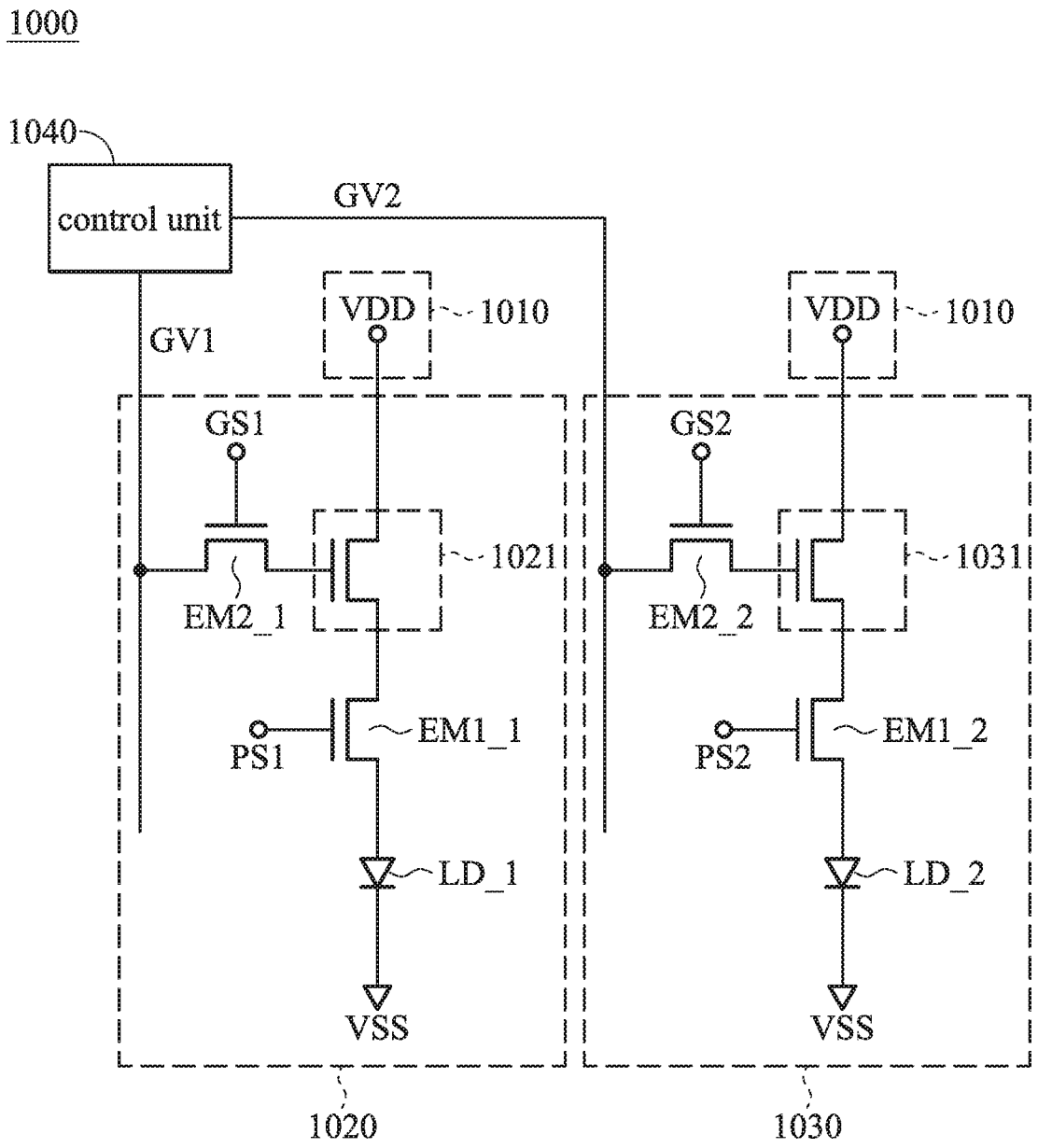
FIG. 10 is a schematic view of an electronic device according to another embodiment of the disclosure.

FIG. 10 is a schematic view of an electronic device according to another embodiment of the disclosure. Please refer to FIG. 10. The electronic device 1000 includes a power source unit 1010, a first electronic unit 1020, a second electronic unit 1030 and a control unit 1040. In an embodiment, the electronic device 1000 may be a display device, but the disclosure is not limited thereto. The first electronic unit 1020 and the second electronic unit 1030 may respectively be sub-pixels, but the disclosure is not limited thereto. The power source unit 1010 provides a power source VDD, wherein the voltage of the power source VDD is the system voltage.

The first electronic unit 1020 includes a first driving unit 1021, a third switch EM1_1, a fourth switch EM2_1 and a light-emitting unit LD_1. The first driving unit 1021 is coupled to the power source unit 1010. In an embodiment, the first driving unit 1021 may be a thin film transistor, but the disclosure is not limited thereto.

The third switch EM1_1 is coupled to the first driving unit 1021. In an embodiment, the third switch EM1_1 may be a thin film transistor, but the disclosure is not limited thereto. In addition, a gate electrode of the third switch EM1_1 receives a pulse signal PS1.

The light-emitting unit LD_1 is coupled to the third switch EM1_1. Furthermore, a first terminal (such as an anode terminal) of the light-emitting unit LD_1 is coupled to one electrode of the third switch EM1_1, and a second terminal (such as a cathode terminal) of the light-emitting unit LD_1 is coupled to a reference voltage VSS (such as a ground voltage).

The fourth switch EM2_1 is coupled to the control unit 1040. In an embodiment, the fourth switch EM2_1 may be a thin film transistor, but the disclosure is not limited thereto. Furthermore, a gate electrode of the fourth switch EM2_1 receives a scan signal GS1, and the fourth switch EM2_1 receives a first gray-level voltage GV1 from the control unit 1040.

The second electronic unit 1030 includes a second driving unit 1031, a third switch EM1_2, a fourth switch EM2_2 and a light-emitting unit LD_2. The second driving unit 1031 is coupled to the power source unit 1010. In an embodiment, the second driving unit 1031 may be a thin film transistor, but the disclosure is not limited thereto.

The third switch EM1_2 is coupled to the second driving unit 1031. In an embodiment, the third switch EM1_2 may be a thin film transistor, but the disclosure is not limited thereto. In addition, a gate electrode of the third switch EM1_2 receives a pulse signal PS2.

The light-emitting unit LD_2 is coupled to the third switch EM1_2. Similarly, the light-emitting unit LD_2 may be a light-emitting diode. Furthermore, a first terminal (such as an anode terminal) of the light-emitting unit LD_2 is coupled to one electrode of the third switch EM1_2, and a second terminal (such as a cathode terminal) of the light-emitting unit LD_2 is coupled to the reference voltage VSS (such as a ground voltage).

The fourth switch EM2_2 is coupled to the control unit 1040. In an embodiment, the fourth switch EM2_2 may be a thin film transistor, but the disclosure is not limited thereto. Furthermore, a gate electrode of the fourth switch EM2_2 receives a scan signal GS2, and the fourth switch EM2_2 receives a second gray-level voltage GV2 from the control unit 1040.

The control unit 1040 is coupled to the fourth switches EM2_1 and EM2_2. In an embodiment, the control unit 1040 may be a micro-controller, a micro-processor, or another suitable element, but the disclosure is not limited thereto. Furthermore, the control unit 1040 is coupled to the fourth switches EM2_1 and EM2_2, and the control unit 1040 provides the first gray-level voltage GV1 and the second gray-level voltage GV2 to drive the first driving unit 1021 and the second driving unit 1031, respectively.

Figure 11:
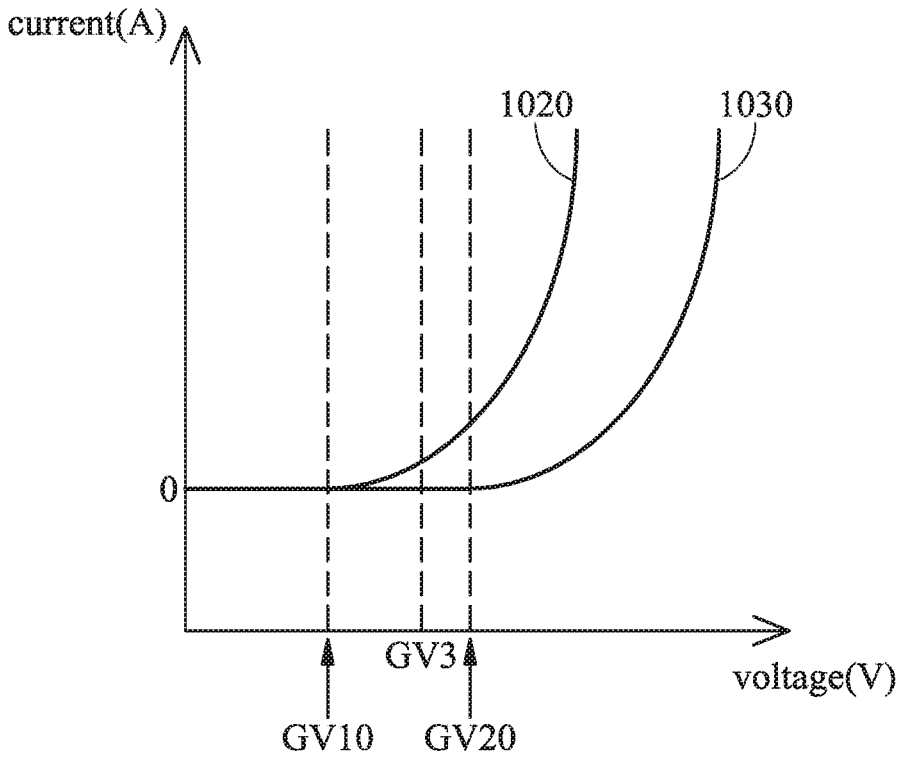
FIG. 11 is a diagram of the relationship between voltage and current in electronic units according to another embodiment of the disclosure.

FIG. 11 is a diagram of the relationship between the voltages and currents of the first electronic unit 1020 and the second electronic unit 1030 in the embodiment of FIG. 10.

Please refer to FIG. 11. In FIG. 11, when the voltage gradually increases and exceeds a threshold, a current starts to pass through the electronic unit, and drives the light-emitting unit LD_1 of the first electronic unit 1020 and/or the light-emitting unit LD_2 of the second electronic unit 1030 to emit light. It should be noted that, in some embodiments, the light-emitting unit LD_1 of the first electronic unit 1020 and the light-emitting unit LD_2 of the second electronic unit 1030 may generate light in different wavelength ranges (different colors). Because of emitting light of different colors or other reasons, there may be a difference in the processing parameters. Due to this difference, when the same voltage (such as a gray-level voltage GV3) is applied to the first electronic unit 1020 and the second electronic unit 1030, there may be no current passing through the light-emitting unit LD_2 of the second electronic unit 1030, yet, and the light-emitting unit LD_2 presents the darkest gray level (gray level 0), but a current already passes through the light-emitting unit LD_1 of the first electronic unit 1020, so that the light-emitting unit LD_1 starts to emit light. That is, in some embodiments, the first basic gray-level voltage GV10 that causes the first electronic unit 1020 to start to generate current passing through the light-emitting unit LD_1 is different from the second basic gray-level voltage GV20 that causes the second electronic unit 1030 to start to generate current passing through the light-emitting unit LD_2. In some embodiments, the second basic gray-level voltage GV20 corresponds to a voltage value that causes the first electronic unit 1020 to generate a light corresponding to gray level 8. In another embodiment, the second basic gray-level voltage GV20 corresponds to a voltage value that causes the first electronic unit 1020 to generate a light corresponding to the gray level 16, but the corresponding voltage value of the second basic gray-level voltage GV20 is not limited thereto.

In the embodiments shown in FIG. 10 and FIG. 11, the control unit 1040 may respectively provide the first gray-level voltage GV1 and the second gray-level voltage GV2 to drive the first driving unit 1021 and the second driving unit 1031 according to the difference between the first electronic unit 1020 and the second electronic unit 1030.

For example, the control unit 1040 may be configured to include a mapping table, wherein the mapping table includes the processing parameters and the corresponding first gray-level voltage GV1 of the light-emitting unit LD_1 of the first electronic unit 1020, as well as the processing parameters and the corresponding second gray-level voltage GV2 of the light-emitting unit LD_2 of the second electronic unit 1030. When the light-emitting unit LD_1 is to be driven, the mapping table in the control unit 1040 may be used to generate the first gray-level voltage GV1 corresponding to the light-emitting unit LD_1 of the first electronic unit 1020. Therefore, the light-emitting unit LD_1 may generate light of a brightness that corresponds to the first gray-level voltage GV1.

Similarly, when the light-emitting unit LD_2 is to be driven, the mapping table in the control unit 1040 may be used to generate the second gray-level voltage GV2 corresponding to the light-emitting unit LD_2 of the second electronic unit 1030. Therefore, the light-emitting unit LD_2 may generate light of a brightness that corresponds to the second gray-level voltage GV2.

In the embodiment, the control unit 1040 may provide different basic gray-level voltages according to the difference between the first electronic unit 1020 and the second electronic unit 1030, and the control unit 1040 may control light-emitting unit LD_1 and light-emitting unit LD_2 to generate light of substantially the same brightness. Therefore, the quality of the electronic device 1000 may be improved.

In the embodiment of FIG. 10, the electronic device 1000 only includes a first electronic unit 1020 and a second electronic unit 1030, but the disclosure is not limited thereto. In some embodiments, the electronic device 1000 may include three or more electronic units, but the driving method is still similar, and the description thereof is not repeated herein.

In summary, according to the electronic device in the disclosure, the first switch of the electronic unit is coupled to the power source unit, the light-emitting unit of the electronic unit is coupled to the first switch, and a plurality of pulse switches of the electronic unit are coupled to the gate electrode of the first switch. In addition, the electronic device in the disclosure may further provide different basic gray-level voltages to different electronic units. Therefore, the circuit design may be changed or the basic gray-level voltage may be changed to effectively control the light-emitting units, so as to improve the quality of the electronic device.

While the disclosure has been described by way of examples and in terms of the preferred embodiments, it should be understood that the disclosure is not limited to the disclosed embodiments. On the contrary, it is intended to cover various modifications, combinations, and similar arrangements (as would be apparent to those skilled in the art). Therefore, the scope of the appended claims should be accorded the broadest interpretation so as to encompass all such modifications, combinations, and similar arrangements.

What is claimed is:

1. An electronic device, comprising:

a power source unit; and an electronic unit, comprising:

a first switch, coupled to the power source unit, wherein the first switch comprises a gate electrode;

a light-emitting unit, coupled to the first switch; and a plurality of pulse switches, coupled to the gate electrode of the first switch, wherein the plurality of pulse switches comprise a first pulse switch and a second pulse switch, gates of the first pulse switch and the second pulse switch are configured to respectively receive different pulse signals, and a first operation time of the first pulse switch is different from a second operation time of the second pulse switch.

2. The electronic device as claimed in claim 1, wherein the electronic device receives image data, wherein the image data has a number of gray-level bit, and a number of pulse switches is equal to the number of gray-level bit.

3. The electronic device as claimed in claim 1, wherein the first operation time of the first pulse switch is twice as long as the second operation time of the second pulse switch.

4. The electronic device as claimed in claim 3, wherein the first operation time comprises a first pulse time and a first interval time.

5. The electronic device as claimed in claim 4, wherein the second operation time comprises a second pulse time and a second interval time, and the second interval time is less than or equal to the first interval time.

6. The electronic device as claimed in claim 5, wherein the electronic device is a display device, and the electronic unit is a sub-pixel.

7. The electronic device as claimed in claim 1, wherein the electronic unit comprises a capacitor, and the capacitor is coupled to the gate electrode of the first switch.

8. The electronic device as claimed in claim 1, further comprising:

a plurality of storage capacitors, coupled to the pulse switches; and a plurality of second switches, coupled to the storage capacitors.

9. The electronic device as claimed in claim 8, wherein a number of the plurality of storage capacitors is equal to a number of the plurality of pulse switches, and a number of the plurality of second switches is equal to the number of the plurality of pulse switches.

10. The electronic device as claimed in claim 8, further comprising a data line, and the plurality of second switches are coupled to the data line.

11. The electronic device as claimed in claim 8, further comprising a first data line and a second data line, a part of the plurality of second switches are coupled to the first data line, and another part of the plurality of second pulse switches are coupled to the second data line.

12. The electronic device as claimed in claim 1, further comprising a data line, and the plurality of pulse switches are coupled to the data line.

13. The electronic device as claimed in claim 1, wherein the electronic device further comprises a first data line and a second data line, the first pulse switch is coupled to the first data line, and the second pulse switch is coupled to the second data line.

14. The electronic device as claimed in claim 1, further comprising:

a driving unit, coupled between the power source and the first switch.

* * * * *